United States Patent [19]

Shimizu et al.

[11] 4,432,533

[45] Feb. 21, 1984

[54] FLAME GUNNING OF REFRACTORY LININGS

[75] Inventors: Masuto Shimizu; Tadashi Morimoto; Motoyasu Yaji; Masaaki Tsukamoto, all of Chiba; Takao Suzuki, Ichihara; Shigeru Ogura, Chiba, all of Japan

[73] Assignee: Kawasaki Steel Corporation, Kobe, Japan

[21] Appl. No.: 364,414

[22] Filed: Apr. 1, 1982

[30] Foreign Application Priority Data

Apr. 6, 1981 [JP] Japan ..... 56-51387
Apr. 6, 1981 [JP] Japan ..... 56-51389
Apr. 6, 1981 [JP] Japan ..... 56-51396

[51] Int. Cl.[3] ..... F27D 1/16
[52] U.S. Cl. ..... 266/44; 266/281
[58] Field of Search ..... 266/281, 280, 286, 44, 266/283, 284; 264/30; 118/47; 427/423; 239/422

[56] References Cited

U.S. PATENT DOCUMENTS 3,883,078 5/1978 Chemeris et al. ..... 239/422

FOREIGN PATENT DOCUMENTS 572512 3/1959 Canada ..... 427/423
246792 5/1967 U.S.S.R. ..... 118/47

*Primary Examiner*—L. Dewayne Rutledge
*Assistant Examiner*—S. Kastler
*Attorney, Agent, or Firm*—Balogh, Osann, Kramer, Dvorak, Genova & Traub

[57] ABSTRACT

A method of repairing a refractory lining of a vessel lined with refractory by flame gunning process, in which a patching material consisting of refractory particles and carbonaceous fuel powder is flame-gunned together with an oxygen containing gas to fuse or semi-fuse the refractory particles in a region surrounded by high-temperature flame and struck against the surface of the refractory lining to produce a deposit layer of the refractory particles, is disclosed. In this method, a patching material having a higher mixing ratio of the fuel powder or only the fuel powder is flame-gunned at an initial stage of the repairing and subsequently patching materials, in which the mixing ratio of the fuel powder is lowered stepwise, are flame-gunned in order with the progress of the repairing, during which a blow rate of the oxygen containing gas is controlled in accordance with the change of the mixing ratio of the fuel powder in the patching material.

5 Claims, 7 Drawing Figures

FLAME GUNNING OF REFRACTORY LININGS

This invention relates to flame gunning of refractory linings, and more particularly to a method of properly and efficiently repairing refractory linings by a flame gunning process with a minimum repairing cost and a feeding apparatus of patching materials used in the operation of this method.

In the refining of molten metal or similar treatments (hereinafter simply referred to as refining), there are usually used vessels lined with refractory, such as converter, ladle and the like. In these vessels, the refractory lining is subjected to violent refining reaction by directly contacting with high-temperature molten metal and molten slag, so that the melting loss and other damages are caused in the lining during the repeated use.

As is well-known in connection with the refining, it is generally advantageous that the damage produced in the refractory lining is restored promptly at a time producing a local damage. For this purpose, there are adapted flame fusion processes with particulate refractories having the same or analogous properties as in bricks used in the refractory lining, among which a flame gunning process wherein a patching material obtained by previously mixing the particulate refractory with a solid fuel powder such as coke powder or the like is accompanied by a high-speed blowing flow of oxygen gas is particularly utilized as disclosed, for example, in U.S. Pat. No. 3,883,078.

Especially, the flame gunning is effective for repairing the refractory lining (hereinafter simply referred to as lining) in the refining vessel such as converter or the like at the operated state of the vessel. In the flame gunning process, the patching material obtained by previously mixing refractory particles with carbonaceous powder, preferably coke powder as a solid fuel is gunned toward the damaged lining surface on the inner wall of the vessel together with oxygen gas, during which the refractory particles are fused or semi-fused in a high-temperature flame produced by the burning of coke powder with oxygen gas, whereby a strong deposit layer is obtained on the inner wall surface of the vessel to be collided with the refractory particles. In this case, the flame temperature during the burning is necessary to be higher than the melting point of the refractory particle.

Now, the flame temperature during the burning by the flame gunning process or waste gas temperature after the burning is determined by solving the following simultaneous equations (1) and (2):

$$Q = Q_1 + \epsilon_{GW} \cdot A \cdot \sigma \left\{ \left( \frac{T_G + 273}{100} \right)^4 - \left( \frac{T_W + 273}{100} \right)^4 \right\} + Q_2 \quad (1)$$

$$T_G = \frac{Q_1}{V \cdot C_{PV} + W \cdot C_{PW}} + T_{AIR}, \quad (2)$$

wherein Q is a quantity of heat introduced, $Q_1$ is a sensible heat of waste gas after the burning, $Q_2$ is heat of dissipation, $T_G$ is a temperature of waste gas, $T_W$ is a temperature of an inner wall surface of the vessel, V is a volume of waste gas, $C_{PV}$ is a specific heat of waste gas, $C_{PW}$ is a specific heat of patching material, W is an amount of patching material, A is a heat transfer area, $\sigma$ is a Stefan-boltzmann's constant, $\epsilon_{GW}$ is an emissivity between flame and inner wall surface, and $T_{AIR}$ is an atmospheric temperature.

As shown in second item on the right of the equation (1), heat transfer from the flame to the inner wall surface always occurs during the repairing, so that the temperature of the inner wall surface gradually rises and hence the flame temperature $T_G$ also rises.

As a factor affecting the flame temperature, there are the heat transfer area A, waste gas volume V and amount of patching material W, i.e. there are the feed rate of patching material per unit time and the ratio of fuel powder previously included in the patching material.

The heat transfer area A included in the equation (1) indicates a size of the vessel. Therefore, the flame gunning conditions for the patching material must be changed with the increase of the heat transfer area A, otherwise the flame temperature lowers.

In this connection, the vessels to be renewed or repaired have various different sizes, an example of which includes ladles mainly used in the transportation and treatment of molten metal, converters as a typical example of refining vessel, and the like. During the repeated renewing or repairing, the refractory lining formed on the inner wall of the vessel is gradually thinned, that is, the internal volume or inner surface area of the vessel is enlarged, and consequently there may be caused a fear of holding no necessary flame gunning ability in compliance with the enlarged degree of the internal volume.

On the other hand, the temperature of the inner wall surface can substantially accurately be estimated from the operating conditions of the refining vessel. Therefore, by changing the feed rate of the patching material per unit time and the ratio of coke included in the patching material in consideration of the internal volume of the vessel, a proper deposit layer of refractory particles can be obtained at a necessary burning flame temperature.

Moreover, the feed rate per unit time must be increased as the internal volume of the vessel increases to require the increase of gunning amount necessary for the repairing, but may be limited by the restrictions of the flame gunning apparatus. Particularly, if it is intended to adapt the flame gunning apparatus to the final enlargement of the internal volume in the converter as previously mentioned, the apparatus is disadvantageously required to be made large. In the latter case, therefore, it is advantageous to increase the ratio of coke included in the patching material.

In FIGS. 1 and 2 are shown influences of different feed rates having a coke ratio of 30% and 40% on the flame temperature at various inner wall surface temperatures, respectively. In this case, the measurement was carried out in a converter provided with a flame gunning apparatus and having heat transfer area of 128 $m^2$ and natural magnesia was used as a refractory particle.

From the data of FIGS. 1 and 2, there are understood the followings:

(1) The flame temperature is apt to rise as the inner wall surface temperature rises;

(2) The flame temperature is apt to be raised as the feed rate per unit time increases; and (3) The flame temperature rises as the coke ratio increases.

In the flame gunning process, the ratio of coke powder to be mixed and the feed rate of the patching material per unit time can be controlled easily, while the temperature of the inner wall surface of the vessel changes in accordance with refining operation states just before the repairing, lost time up to the beginning of the refining and the like and gradually rises with the advance of the flame gunning to bring about the rising of the flame temperature. Therefore, the feature that the inner wall surface temperature is always measured during the flame gunning is particularly significant in the actual operation for the flame gunning.

In this point, however, the prior art as previously mentioned only discloses that the patching material to be used contains a relatively large amount of coke in order to surely fuse the refractory particles. In this case, a heat quantity fairly larger than the theoretically required one is supplied into the flame gunning system, so that the heat efficiency becomes poor and the cost is too expensive. On the other side, when the coke ratio is reduced so as to improve the heat efficiency, if the inner wall surface temperature is unsatisfactorily low, there can not be obtained a flame temperature enough to fuse the refractory particles, so that the greater part of the patching material becomes wasteful without contributing to the flame gunning and the required repairing is not attained.

In general, the inner wall surface temperature is low at the initial stage of the flame gunning and gradually rises with the advance of the flame gunning. If it is intended to continue the flame gunning operation under the feed rate and coke ratio adapted for the inner wall surface temperature at the initial stage, the combustion heat quantity of coke powder becomes wasteful owing to the rising of the inner wall surface temperature at the last stage. While, if it is intended to continue the flame gunning operation under the feed rate and coke ratio adapted for the inner wall surface temperature at the last stage, the refractory particles are not fused at the initial stage and are wasted.

It is, therefore, an object of the invention to solve the above mentioned drawbacks of the prior art and to advantageously achieve proper repairing for the lining by adjusting optimum coke ratio and feed rate in accordance with the change of the inner wall surface temperature to control the flame temperature capable of realizing effective flame gunning.

As seen from the experiences of the flame gunning operation, the invention has been based on the fact that the bonding ability of refractory particles to the lining is good when the flame gunning is performed at a high flame temperature or when the coke ratio is high.

According to the invention, there is the provision of in a method of repairing a refractory lining of a vessel lined with refractory by flame gunning process in which a patching material consisting of refractory particles and carbonaceous fuel powder is flame-gunned together with an oxygen containing gas to fuse or semi-fuse the refractory particles in a region surrounded by high-temperature flame and struck against the surface of the refractory lining to produce a deposit layer of the refractory particles, the improvement wherein a patching material having a higher mixing ratio of fuel powder or only the fuel powder is flame-gunned at an initial stage of the repairing and subsequently patching materials, in which the mixing ratio of fuel powder is lowered stepwise, are flame-gunned in order with the progress of the repairing, during which a blow rate of the oxygen containing gas is controlled in accordance with the change of the mixing ratio of fuel powder in the patching material.

In the preferred embodiments of the invention, the flame temperature is optimized by selecting or adjusting the mixing ratio of refractory particle to fuel powder in the patching material in accordance with the change of temperature rising on the inner wall surface of the vessel, or by selecting or adjusting a feed rate per unit time of the patching material consisting of refratory particles and fuel powder and a mixing ratio of fuel powder included in the patching material in accordance with the change of temperature rising on the inner wall surface of the vessel. Further, at least one of the feed rate per unit time of the patching material consisting of refractory particles and fuel powder and the mixing ratio of fuel powder included in the patching material is previously set in accordance with the size of the vessel to be repaired, the englargement of the damaged area and the inner wall surface temperature of the vessel. And also, the oxygen containing gas is blown in such an amount that the oxygen content in the gas is substantially less than the theoretical amount required for complete combustion of fuel powder. Moreover, the refractory particles are such a material or blend that the melting point of the refractory particle exceeds the temperature level of the vessel under the operating conditions but is small in the difference between both temperatures.

In the operation of the flame gunning process according to the invention, there is used an apparatus for feeding a patching material, which is communicated with a flame gunning lance of multiple concentric tubes to form a passage for the patching material, a passage for an oxygen containing gas and passages for feeding and returning a cooling liquid, comprising at least two separate tanks for storing the patching material, a pipeline for the patching material provided with a flow control valve and extending from each of the tanks to the passage for the patching material, a pipeline for a carrier gas provided with a flow control valve and connected to each of the tanks and pipelines for the patching material, and a pipeline for the oxygen containing gas provided with a flow control valve and communicating with the passage for the oxygen containing gas. In this case, the refractory particles and fuel powder may be separately charged into the tanks, or at least two patching materials having different mixing ratios of refractory particle to fuel powder may be reserved in at least two separate tanks.

According to the apparatus of the above mentioned construction, the mixing ratio of refractory particle to fuel powder can be changed in accordance with the state of the inner wall surface of the vessel to be repaired. In an extreme case, the flame gunning lance may be used as a mixer for the fuel powder and the oxygen containing gas so as to develop the function of burner. Therefore, when repairing the inner wall of the refining vessel wherein the inner wall surface temperature is relatively low (e.g. not more than 1,000° C.), the fuel powder alone or the patching material having a higher mixing ratio of fuel powder is first fed at the initial stage of the repairing and thereafter the patching material having a higher mixing ratio of refractory particles is fed so as to finally achieve a proper mixing ratio of refractory particle of 60–70% as the inner wall surface temperature gradually rises.

The invention will now be described with reference to the accompanying drawings, wherein.

Figure 1:
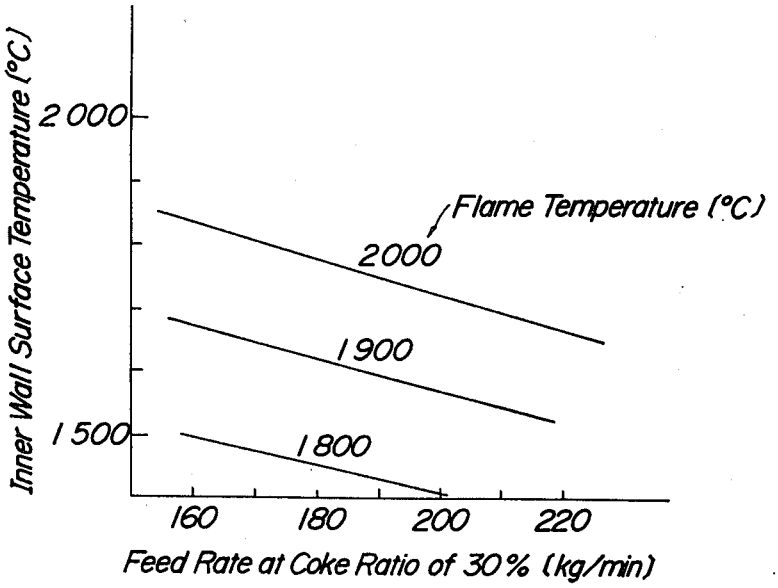
FIGS. 1 and 2 are graphs showing influences of the inner wall surface temperature of the vessel and the feed rate of the patching material on the flame temperature at coke ratios of 30% and 40%, respectively.
Figure 2:
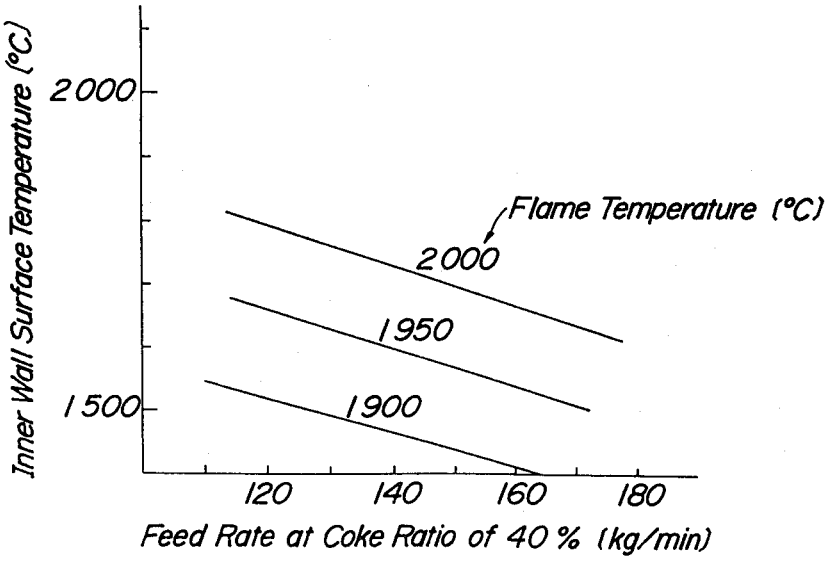
Figure 3:
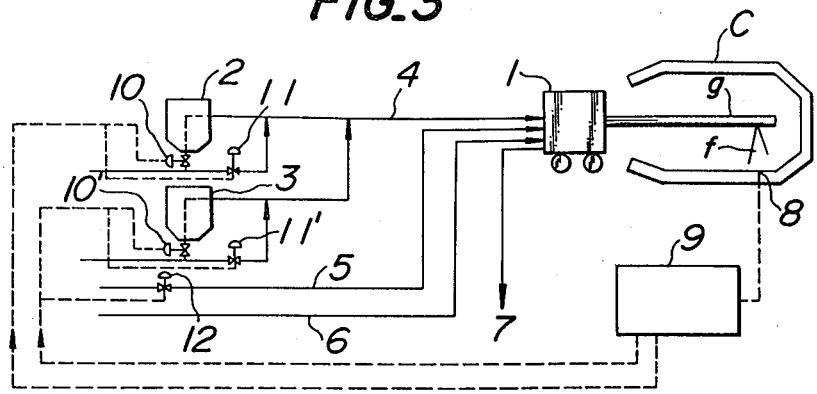
FIG. 3 is a schematic view of an embodiment of the apparatus for feeding of patching material used in the flame gunning process according to the invention.

In the flame gunning process according to the invention, the inner wall surface temperature of the vessel to be repaired is first measured by means of a radiation pyrometer before the start of the repairing, from which is estimated a change of the inner wall surface temperature during the flame gunning, whereby the feed rate of the patching material and the mixing ratio of fuel powder are determined. Alternatively, a thermocouple or the like is embedded in the lining of the vessel to directly measure the temperature of the lining and the same operation as described above can surely be performed on the basis of the measured value. Moreover, the measurement of the inner wall surface temperature may be performed by any measuring devices usually used in this field In FIG. 3 is shown an embodiment of the apparatus for use in the flame gunning process operated according to the temperature of the inner wall of the vessel measured by the thermocouple embedded therein. In the apparatus of FIG. 3, numeral 1 is a self-propelled truck for operating a flame gunning lance g, numeral 2 a tank for storing refractory particles, numeral 3 a tank for storing coke powder as a fuel, numeral 4 a pipeline for transporting a patching material consisting of refractory particles and coke powder, numeral 5 a pipeline for an oxygen gas, numerals 6 and 7 pipelines for feeding and returning a cooling water, numeral 8 a thermocouple embedded in an inner wall of a converter C, numeral 9 a control unit, numerals 10 and 10′ flow control valves for adjusting the pressure inside the tanks 2 and 3, numerals 11 and 11′ flow control valves for carrier gas, numeral 12 a flow control valve for oxygen gas, and alphabet f a gunning flame.

At first, the lining temperature on the inner wall of the converter C is measured by the thermocouple 8. Then, the feed rate of the patching material and blow rate of oxygen gas are adjusted through the control unit 9 based on the above measured temperature. Thereafter, the flame gunning is carried out at the top end of the flame gunning lance g.

The refractory particles and coke powder are supplied from the respective tanks 2, 3 into the pipeline 4 for the transportation of the patching material in feed rates determined by adjusting openings of flow control valves 10, 10′, 11, 11′ in accordance with the outputs of the control unit 9.

On the other hand, the flow rate of oxygen gas is controlled by the flow control valve 12 so as to achieve approximately the theoretical amount required for complete combustion of the given flow rate of coke powder. As mentioned above, the mixing ratio of coke powder is determined on the basis of the lining temperature measured by the thermocouple in order to provide a flame temperature required for fusing the refractory particles, so that the blow rate of oxygen gas is determined by adjusting the opening of the flow control valve 12 in accordance with the output of the control unit 9 based on the determined mixing ratio of coke powder.

In the illustrated embodiment, the refractory particles and coke powder are separately stored in the tanks 2 and 3, but plural patching materials having different mixing ratios of refractory particle to coke powder may be separately reserved in plural tanks. In the latter case, the same results as in the illustrated embodiment are obtained by selecting the feeding order of these patching materials to perform the flame gunning. Moreover, even when the mixing ratio of coke powder in the patching material can not be changed in the installation to be used, substantially the same operation can be performed by previously determining optimum mixing ratio of coke powder under consideration of flame gunning time and heat efficiency.

Since the change of the lining temperature can be estimated from the lapse time of the repairing by accumulating, for example, the data of operational result, the actual measurement of the lining temperature is not always performed during the repairing, but it is, of course, desirable to take the actually measued temperature into account as at least a factor for the arrangement of the above data.

The invention will be further described in detail with respect to the case of repairing the refractory lining of the refining vessel.

In the conventional converter, there have been adopted semi-dry repairing methods, wherein the refractory particles in the patching material are chemically adhered to each other and to the inner wall lining of the refining vessel by bonding force of several weight percents of a binder contained in the patching material. In these two methods, therefore, the refractory particle must be used to have a melting point largely higher than the tapping temperature of the refining vessel under operating conditions of this vessel. For instance, when the tapping temperature is 1,600° C., the refractory particles having a melting point of about 2,400° C. must be used, while when the tapping temperature is 1,800° C., if the refractory particles having a melting point of about 2,400° C. is used likewise the above case, the melting loss becomes conspicuous. In the later case, the refractory particle having a more higher melting point must be used in order to reduce the melting loss, but such a raising of the melting point in the refractory particle is not too effective because the bonding force between particles is ultimately a chemically weak force. Therefore, both the methods have such drawbacks that the cost of the patching material necessarily increases and also the scattering of the durability after the repairing becomes large.

On the contrary, in the method of repairing refractory linings by flame gunning process according to the invention, the refractory particles are bonded at at least a semi-fused state to each other and to the inner wall lining of the refining vessel. As a result, the bonding force in this method is extremely excellent and stable as compared with the chemically bonding force of the binder as described above. Therefore, the flame gunning process makes it possible to efficiently select the refractory particles in accordance with the operating conditions of the refining vessel.

Namely, when the tapping temperature of the refining vessel is a relatively lower temperature level, refractory particles having a melting point slightly higher than the above level may be used, while then the tapping temperature is a relatively higher level, the refractory particles may be selected from ones having a melting point higher than the tapping temperature level but a small difference between the melting point and the tapping temperature, so that a fairly stable repairing can be performed as compared with the prior art and also the cost of the patching material becomes largely inexpensive.

Now, the operating conditions in the refining vessel are generally classified into the following three cases:

(1) The refining is performed at a relatively low temperature level without substantially scattering;

(2) The refining is performed at a relatively high temperature level without substantially scattering; and (3) The refining is performed with a large fluctuation extending from the low temperature level to the high temperature level.

According to the invention, the repairing treatment by the flame gunning process may be followed to each of the above-cases (1)–(3). That is, at least two patching materials containing refractory particles with a relatively low melting point are separately stored in at least two tanks in regard to the case (1), and at least two patching materials containing refractory particles with a higher melting point are separately stored in at least two tanks in regard to the case (2), and several patching materials containing refractory particles with different melting points are separately stored in several tanks in regard to the case (3). In any case, these patching materials are flame-gunned through the transporting pipeline and flame gunning lance onto the inner wall surface of the refining vessel to be repaired. Therefore, the blowing operation matching with each refining condition of the above cases (1)–(3) may be carried out after the completion of the repairing.

In the actual repairing operation, it is a greatest point to select what kind of refractory particles, whose melting point is higher than the tapping temperature of the refining vessel to some extent. As previously mentioned, the bonding force of the repaired portion by the flame gunning process is considerably strong owing to the bonding at fused or semi-fused state of refractory particle. Therefore, it is sufficient to use refractory particle having a melting point higher by about 200°–300° C. than the tapping temperature of the refining vessel.

Figure 4:
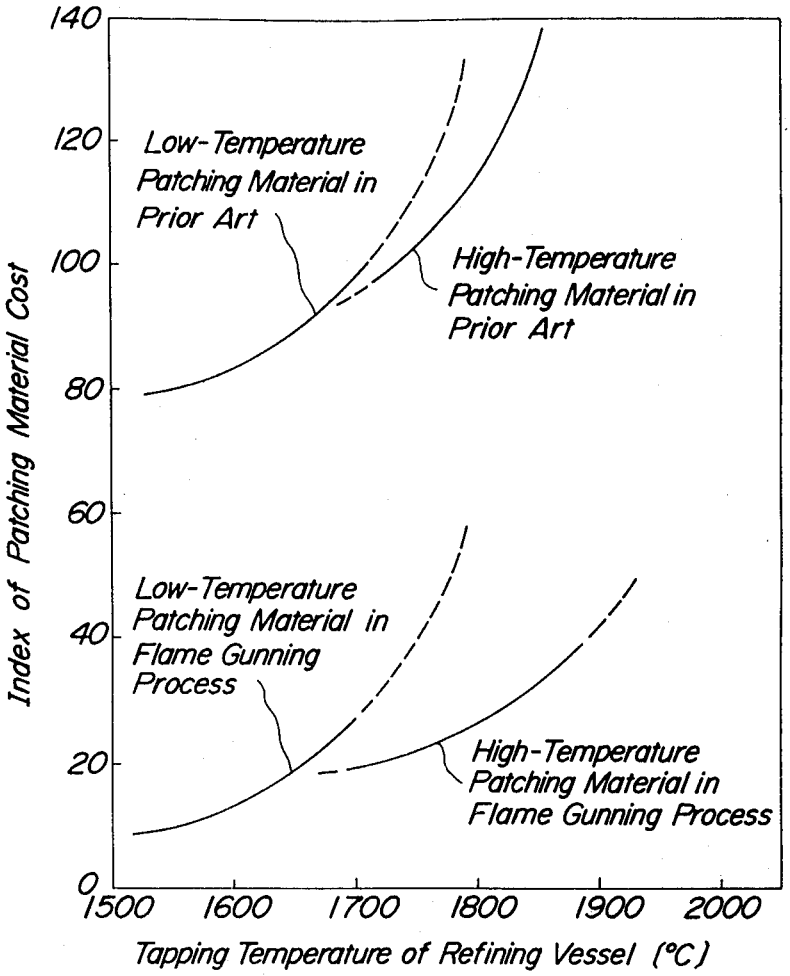
FIG. 4 is a graph showing a relation between the tapping temperature of the refining vessel and the index of the patching material cost.

In FIG. 4 is shown an index of patching material cost at each patching material in accordance with the tapping temperature of the refining vessel. Here, the index of patching material cost is indicated on the basis that the cost of refractory particles per unit cost of patching material used in the prior art is 100. It can be seen from FIG. 4 that according to the prior art, the durable effect of the repaired portion is not so sufficient even if the melting point is raised in accordance with a high tapping temperature level because the bonding force of the repaired portion is weak, while according to the invention, the durable effect of the repaired portion becomes more sufficient as the melting point of the refractory particle rises because the refractory particles are bonded to each other and to the inner wall of the vessel at at least a semi-fused state in the flame gunning process.

Moreover, the use of high-temperature patching material is not effective at the tapping temperature below 1,700° C. in the flame gunning process as compared with the use of low-temperature patching material because the bonding state of the repaired portion using the high-temperature patching material becomes more dense and is apt to accelerate the melting loss due to peeling under thermal change (or thermal spalling).

In this connection, the followings show the comparative data of repairing result between the conventional semi-dry repairing method and the repairing method by the flame gunning process according to the invention when the tapping temperature of the refining vessel is 1,600° C. and 1,800° C., respectively.

| | Conventional method | Flame gunning process according to the invention |
|---|---|---|
| (1) Refining vessel at tapping temperature of 1,600° C. | | |
| Melting point of refractory particle | 2,400° C. | 1,900° C. |
| Repairing thickness | 20 mm | 40 mm |
| Durable number after repairing | 4 charges | 7 charges |
| Melting loss rate | 5 mm/charge | 6 mm/charge |
| Index of unit | 100 | 54 |
| Index of patching material cost | 100 | 18 |
| Chemical composition of patching material used, weight % | | |
| MgO | 81 | 73 |
| CaO | 11 | 10 |
| $Fe_2O_3$ | 1 | 6 |
| $SiO_2$ | 3 | 10 |
| Ignition loss | 4 | 1 |

| | Conventional method | Flame gunning process according to the invention |
|---|---|---|
| (2) Refining vessel at tapping temperature of 1,800° C. | | |
| Melting point of refractory particle | 2,600° C. | 2,100° C. |
| Repairing thickness | 30 mm | 50 mm |
| Durable number after repairing | 2 charges | 3 charges |
| Melting loss rate | 15 mm/charge | 17 mm/charge |
| Index of unit | 100 | 60 |
| Index of patching material cost | 100 | 20 |
| Chemical composition of patching material used, weight % | | |
| MgO | 90 | 79 |
| CaO | 3 | 11 |
| $Fe_2O_3$ | 1 | 3 |
| $SiO_2$ | 2 | 6 |
| Ignition loss | 4 | 1 |

As apparent from the above, the invention makes it possible to considerably reduce the patching material cost in both the cases of high and low tapping temperatures as compared with the conventional method because the index of unit is less.

In the repairing method by the flame gunning process according to the invention as described above, the repairing number during the use life of the refining vessel or the converter was about 600. Before the refining, the inner surface area of the new converter lined with refractory bricks was about 100 $m^2$, but the inner surface area of the converter during the repeated refining was 118 $m^2$ at the 200th repairing, 128 $m^2$ at the 400th repairing and 137 $m^2$ at the 600th repairing. Since the maximum discharge rate of the patching material from the flame gunning lance used was 210 kg/min, the deposit layer having an average porosity of not more than 20% can be obtained from the patching material having a coke ratio of 30% until the 200th repairing, but the porosity tends to increase when the repairing is further continued under the same conditions as described above. Thereupon, the coke ratio is changed from 30 to 33% until the 400th repairing and further to 35.5% after the 400th repairing, whereby the formation of deposit layer having an average porosity of not more than 20% can be retained.

Figure 5:
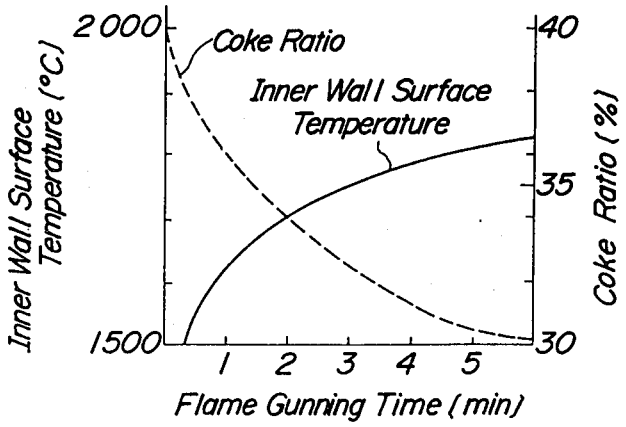
FIG. 5 is a graph showing an influence of the flame gunning time on the change of the inner wall surface temperature and the coke ratio for making the flame temperature constant.

In this connection, FIG. 5 shows an embodiment of controlling the coke ratio in accordance with the inner wall surface temperature of the converter measured by the thermocouple embedded therein and the change of the inner wall surface temperature during the flame gunning is also shown in FIG. 5. In this embodiment, when the feed rate per unit time of the patching material is the maximum discharge rate from the flame gunning lance used, the flame temperature is made constant without lowering heat efficiency by changing the coke ratio of the patching material in accordance with the change of the inner wall surface temperature.

As regards FIG. 5, the following experiments were carried out using the apparatus provided with the flame gunning lance g as shown in FIG. 3. At first, a patching material A having a coke ratio of 40% and containing natural magnesia as a refractory particle was charged in the tank 2, while a patching material B having a coke ratio of 30% and containing natural magnesia was charged in the tank 3. Then, the flame gunning of the patching material on the lining of the converter C was started at the inner wall surface temperature of 1,200° C. as measured by the thermocouple 8 by discharging the patching material from the nozzle of the lance g at a feed rate of 200 kg/min.

In the first experiment, the patching material A was flame-gunned for 2 minutes and then the patching material B was flame-gunned for 3 minutes. In this way, the deposit layer was formed with an adhesion degree of 95% and coke powder was consumed in an amount of 0.49 kg per 1 kg of the deposited refractory particle.

In the second experiment, only the patching material B was flame-gunned for 5 minutes under the same conditions as described above. In this case, the coke ratio was not so high against the inner wall surface temperature at the beginning of the flame gunning, so that the flame temperature was not raised sufficiently. As a result, the adhesion degree was restricted to 83%, while coke powder was consumed in an amount of 0.52 kg per 1 kg of the deposited refractory particle.

In the third experiment, only the patching material B was flame-gunned for 5 minutes under the same conditions as described above. In this case, the adhesion degree was as high as 98%, while coke powder was excessively consumed in an amount of 0.68 kg per 1 kg of the deposited refractory particle.

As apparent from the above experiments, the flame temperature can be optimized by controlling the coke ratio of the patching material in accordance with the change of the measured inner wall surface temperature.

Further, it has been confirmed that the effective repairing time can be shortened to 60% of that required in the conventional method and the loss of refractory particles is reduced to 80% of that produced in the conventional method because the loss toward the exterior at the initial stage of the flame gunning considerably reduces. Moreover, it has been confirmed that the corrosion resistance of the deposit layer is increased up to 30% because the deposition in the low temperature region reduces at the initial stage of the flame gunning.

As described above, according to the invention, the repairing operation can be performed with a high efficiency and reduction of refractory loss in a short time. Furthermore, an optimum repairing result can be obtained by optionally changing the mixing ratio of refractory particle and fuel powder in accordance with the combustion state during the flame gunning. Therefore, it makes possible to efficiently flame-gun the patching material to increase the adhesion efficiency of refractory particle and at the same time to reduce the cost of the patching material itself. As a result, when the damaged portion of the refractory lining is repaired by the method according to the invention using the flame gunning process, the reduction of the repairing cost can advantageously be realized by selecting refractory particles having a lower melting point within a limit capable of satisfying performances required under operating conditions, particularly temperature level applied to the repaired refractory lining.

The inventors have made various examinations on the thermal resistance of the refractory lining after the repairing and found that abnormal melting loss may be produced on the surface of non-flame gunned region in the repairing. Of course, such an abnormal melting loss of non-flame gunned region is disadvantageous in the reparing by the flame gunning process.

Now, the inventors have made further investigations in order to solve the above disadvantage and found out that the abnormal melting loss of non-flame gunned region during the flame gunning results from surplus oxygen remaining in combustion gas.

That is, according to the flame gunning process, the oxygen containing gas is usually blown in such a manner that the oxygen content is somewhat larger than the theoretical amount required for complete combustion of fuel powder, so that surplus oxygen not contributing to combustion usually remains in combustion gas. As a result, the surplus oxygen entrained in the high-temperature combustion gas produces the abnormal melting loss of non-flame gunned region in the refractory lining when contacting with the surface of such region.

According to the invention, therefore, the oxygen containing gas is preferably blown in such a manner that the surplus oxygen in combustion gas is substantially zero, i.e. the oxygen content in the oxygen containing gas is substantially less than the theoretical amount required for complete combustion of solid fuel powder, whereby an unexpected result is obtained for preventing the abnormal melting loss of the non-flame gunned region.

In this connection, the invention will now be described in detail with reference to the following experiment.

Figure 6:
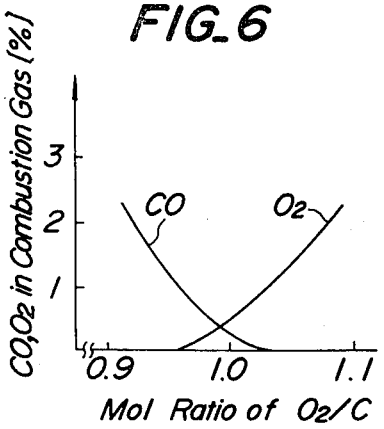
FIG. 6 is a graph showing a relation between the mol ratio of $O_2/C$ and the $O_2$ and CO contents in combustion gas.
Figure 7:
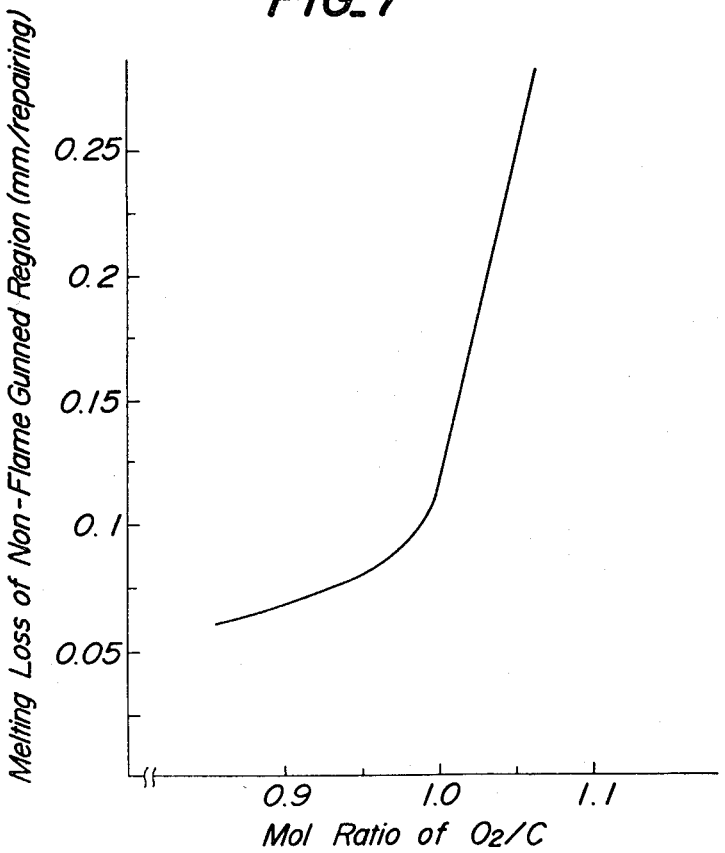
FIG. 7 is a graph showing a relation between the mol ratio of $O_2/C$ and the melting loss of non-flame gunned region.

In this experiment, coke powder and oxygen gas were used as solid fuel powder and oxygen containing gas, respectively, and the repairing of the refractory lining by the flame gunning process was carried out by changing the mol ratio of oxygen gas to coke powder ($O_2/C$), during which CO and $O_2$ contents contained in combustion gas and the melting loss of non-flame gunned region were measured to obtain results as shown in FIGS. 6 and 7, respectively, As apparent from FIG. 6, even when the mol ratio of $O_2/C$ is 1 for theoretically achieving complete combustion of coke powder, uncombusted coke powder remains in the combustion system because the complete combustion can not be achieved in fact. Therefore, the oxygen gas has been blown in an amount excessively larger than the theoretical amount required for complete combustion of coke powder as previously mentioned. In this case, however, the melting loss of non-flame gunned region rapidly increases when the mol ratio of $O_2/C$ exceeds 1 as shown in FIG. 7.

On the other hand, as apparent from FIG. 7, the melting loss of non-flame gunned region is very low when the oxygen content is within a range of $O_2/C<1$ achieving no complete combustion of coke powder. Therefore, the blow rate of oxygen gas for coke powder according to the invention is preferable to be a mol ratio ($O_2/C$) of less than 1. However, the larger amount of uncombusted coke powder is uneconomical and also there is caused a risk of exposing the surroundings to an elevated temperature atmosphere due to combustion of uncombusted coke powder by contacting ambient atmosphere with high temperature waste gas containing uncombusted coke powder. For this reason, the mol ratio of $O_2/C$ is not less than 0.6, preferably not less than 0.8 in practice.

The following experiment was made in order to show that the abnormal melting loss of non-flame gunned region is prevented by burning solid fuel powder with oxygen gas under such a condition that surplus oxygen in combustion gas is substantially zero.

That is, a damaged portion of a refractory lining in a converter of 200t capacity was repaired by the flame gunning process under the following conditions and thereafter the melting loss of non-flame gunned region was measured to obtain a result as shown in the following Table 1.

| | |
|---|---|
| Refractory particle | natural magnesia ($MgO$: 93%, $SiO_2$: 7%) |
| Mixing ratio of refractory particle to coke powder (purity: 88%) = | 70:30 (in weight %) |
| Feed rate of patching material | 200 kg/min |
| Blow rate of oxygen | 95 $Nm^3$/min |
| Feed rate of carrier gas | 400 $Nm^3$/min |
| Mol ratio of $O_2/C$ | 0.95 |
| Repairing time | 6 minutes |

For the comparison, the same repairing operation as described above was repeated except that the mol ratio of $O_2/C$ was made 1.05 by changing the blow rate of oxygen. Thereafter, the melting loss of non-flame gunned region was measured to obtain a result as shown in Table 1.

TABLE 1

| Mol ratio of $O_2/C$ | Melting loss (mm/repairing) |
|---|---|
| 0.95 | 0.08 |
| 1.05 | 0.25 |

As apparent from Table 1, when the oxygen content in the oxygen containing gas is substantially less than the theoretical amount required for complete combustion of fuel powder, the melting loss of non-flame gunned region largely reduces in the repairing by the flame gunning process.

According to the invention, the repairing of refractory linings in the converter by the flame gunning process is usually performed at such a state that the lining is held at a sufficiently higher temperature just after molten metal and slag are tapped from the converter. If the inner wall surface temperature is lowered by some reason and should be preheated prior to the repairing, the heated by flame gunning may be carried out by feeding only the solid fuel powder or by feeding the patching material containing an extremely reduced quantity of refractory particle. In this case, the melting loss of refractory lining can advantageously be prevented by blowing the oxygen containing gas within the blow rate range as defined above.

Although the invention has been described with respect to the repairing of refractory linings in the converter, it can be applied to the repairing operation in the other refining vessels, heating oven, holding furnace, coke oven and the like. In any case, according to the invention, when the repairing of refractory linings is performed by the flame gunning process, the flame temperature can properly be controlled by adjusting the mixing ratio of solid fuel powder in the patching material and further the feed rate of the patching material in accordance with the change of the inner wall surface temperature during the repairing, so that the deposit layer of refractory particle having a higher bonding strength can advantageously be formed without causing wastefulness of refractory particle and fuel powder. Therefore, the repairing for any melting loss produced in the refractory lining can be performed easily, surely and properly. Furthermore, according to the invention, the abnormal melting loss of non-flame gunned region can largely be mitigated in the repairing of refractory linings by the flame gunning process.

What is claimed is:

1. In a method of repairing a refractory lining of a vessel lined with refractory by a flame-gunning process, comprising flame-gunning a patching material consisting of refractory particles and carbonaceous fuel powder, together with an oxygen containing gas to fuse or semi-fuse the refractory particles in a region surrounded by high temperature flame, and strucking the flame-gunned material against the surface of the refractory lining to produce a deposit layer of the refractory particles, the improvement comprising flame-gunning at an initial stage of repairing a patching material having a higher mixing ratio of the fuel powder, and subsequently flame-gunning, in order with the progress of rapairing, patching materials in which the mixing ratio of the fuel powder is lowered stepwise, and during which blowing the oxygen containing gas in such an amount that the oxygen content in the oxygen containing gas is substantially less than the theoretical amount required for complete combustion of the fuel powder, and controlling a blow rate of the oxygen containing gas in accordance with the change of the mixing ratio of the fuel powder in the patching material.

2. A method according to claim 1, wherein a flame temperature during the flame gunning is optimized by selecting or adjusting the mixing ratio of refractory particle to fuel powder in the patching material in accordance with the change of temperature rising on the inner wall surface of the vessel.

3. A method according to claim 1, wherein a flame temperature during the flame gunning is optimized by selecting or adjusting a feed rate per unit time of the patching material and the mixing ratio of the fuel powder in the patching material in accordance with the change of temperature rising on the inner wall surface of the vessel.

4. A method according to claim 3, wherein at least one of the feed rate per unit time of the patching material and the mixing ratio of the fuel powder in the patching material is previously set in accordance with a size of the vessel to be repaired or an enlargement of an area to be repaired as well as the inner wall surface temperature previously measured.

5. A method according to claim 1, wherein the refractory particle is such a material or blend that the melting point of the refractory particle exceeds the temperature level of the vessel under operating conditions thereof but is small in the difference between both temperatures.

* * * * *